US009791193B2

(12) United States Patent
Lee

(10) Patent No.: US 9,791,193 B2
(45) Date of Patent: Oct. 17, 2017

(54) AIR CONDITIONER AND METHOD OF CONTROLLING THE SAME

(75) Inventor: Jaewan Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 702 days.

(21) Appl. No.: 13/433,473

(22) Filed: Mar. 29, 2012

(65) Prior Publication Data

US 2013/0104576 A1 May 2, 2013

(30) Foreign Application Priority Data

Oct. 27, 2011 (KR) ..... 10-2011-0110389

(51) Int. Cl.
*F25D 21/06* (2006.01)
*F25B 47/02* (2006.01)
*F25B 13/00* (2006.01)

(52) U.S. Cl.
CPC ..... *F25B 47/02* (2013.01); *F25B 13/00* (2013.01); *F25B 47/022* (2013.01); *F25B 2313/023* (2013.01); *F25B 2313/025* (2013.01); *F25B 2313/0251* (2013.01); *F25B 2313/0252* (2013.01); *F25B 2313/0253* (2013.01); *F25B 2313/02321* (2013.01); *F25B 2313/02521* (2013.01); *F25B 2313/02522* (2013.01); *F25B 2313/02523* (2013.01); *F25B 2313/02531* (2013.01); *F25B 2313/02532* (2013.01);

(Continued)

(58) Field of Classification Search
CPC ..... F25B 2313/0252; F25B 2313/0251; F25B 2313/02521; F25B 2313/02522; F25B 2313/02523; F25B 2313/0253; F25B 2313/02531; F25B 2313/02532; F25B 2313/02533; F25B 2313/02512; F25B 2313/02321; F25B 47/02; F25B 47/025
USPC ..... 62/151, 152, 155
See application file for complete search history.

(56) References Cited

U.S. PATENT DOCUMENTS 4,122,686 A * 10/1978 Lindahl et al. ..... 62/81
4,151,722 A * 5/1979 Willitts et al. ..... 62/155
(Continued)

FOREIGN PATENT DOCUMENTS

EP 2 204 625 A1 7/2010
JP 2002-188873 7/2002
(Continued)

OTHER PUBLICATIONS http://www.achrnews.com/articles/electronic-expansion-valves-the-basics, The Air Conditioning, Heating and Refrigeration News, Published Aug. 2, 2004.*
(Continued)

*Primary Examiner* — David Teitelbaum
(74) *Attorney, Agent, or Firm* — KED & Associates, LLP

(57) ABSTRACT

An air conditioner may include a plurality of indoor units and a plurality of outdoor units connected to the plurality of indoor units. Each of the plurality of outdoor units may include a plurality of outdoor heat exchangers. Each of the outdoor heat exchangers may include a plurality of heat exchanger parts. When a defrosting operation condition is satisfied during a heating operation, indicating that a defrosting operation should be performed the plurality of heat exchanger parts of the plurality of outdoor heat exchangers may successively perform the defrosting operation.

6 Claims, 9 Drawing Sheets

(52) U.S. Cl.
CPC ..... *F25B 2313/02533* (2013.01); *F25B 2313/02742* (2013.01); *F25B 2400/0411* (2013.01)

(56) References Cited

U.S. PATENT DOCUMENTS 4,691,527 A * 9/1987 Ikeda ..... A47F 3/0447 62/197
4,698,981 A * 10/1987 Kaneko ..... F25B 13/00 62/180
4,774,813 A 10/1988 Yokoyama
5,142,879 A * 9/1992 Nakamura et al. ..... 62/160
5,279,131 A * 1/1994 Urushihata ..... F24F 3/065 62/117
5,467,604 A * 11/1995 Sekigami et al. ..... 62/117
6,012,294 A * 1/2000 Utsumi ..... 62/81
6,629,422 B2 * 10/2003 Wellman ..... 62/155
7,171,817 B2 * 2/2007 Birgen ..... 62/81
2004/0139755 A1 * 7/2004 Park et al. ..... 62/199
2007/0130967 A1 * 6/2007 Park et al. ..... 62/151
2009/0044550 A1 * 2/2009 Nishimura ..... F25B 49/005 62/149

FOREIGN PATENT DOCUMENTS

JP 2009-281698 12/2009
KR 100820821 B1 4/2008
KR 10-2010-0081621 7/2010

OTHER PUBLICATIONS

Korean Office Action issued in KR Application No. 10-2011-0110389 dated Apr. 15, 2013.
Korean Notice of Allowance dated Sep. 16, 2013.
European Search Report dated Dec. 6, 2013 for corresponding Application No. 12161518.1.

* cited by examiner

AIR CONDITIONER AND METHOD OF CONTROLLING THE SAME

CROSS-REFERENCE TO RELATED APPLICATION(S)

This application claims priority under 35 U.S.C. §119 to Korean Application No. 10-2011-0110389 filed in Korea on Oct. 27, 2011, whose entire disclosure is hereby incorporated by reference.

BACKGROUND

1. Field

This relates to an air conditioner.

2. Background

In general, air conditioners provide cooling/heating to an indoor space and/or purify air using a refrigerant cycle including a compressor, condenser, an expansion mechanism, and an evaporator. Some air conditioners may include a single indoor unit connected to a single outdoor unit. Other, multi-type air conditioners may include a plurality of indoor units connected to one or more outdoor units to provide the effect of a plurality of air conditioners. In a multi-type air conditioner, when a heating operation is continuously performed, frost may accumulate on an outdoor heat exchanger. During a defrosting process, one outdoor unit of a plurality of outdoor units may perform a cooling operation, with the defrosting process being performed on an outdoor heat exchanger of the outdoor unit in which the cooling operation is performed. However, since the remaining outdoor units continue to perform a heating operation, heating efficiency may be deteriorated due to the defrosting operation.

An air conditioner may include a plurality of indoor units and a plurality of outdoor units connected to the plurality of indoor units. Each of the plurality of outdoor units may include a plurality of outdoor heat exchangers. Each of the outdoor heat exchangers may include a plurality of heat exchanger parts. When a defrosting operation condition is satisfied during a heating operation, indicating that a defrosting operation should be performed the plurality of heat exchanger parts of the plurality of outdoor heat exchangers may successively perform the defrosting operation.

BRIEF DESCRIPTION OF THE DRAWINGS

The embodiments will be described in detail with reference to the following drawings in which like reference numerals refer to like elements wherein.

DETAILED DESCRIPTION

Figure 1:
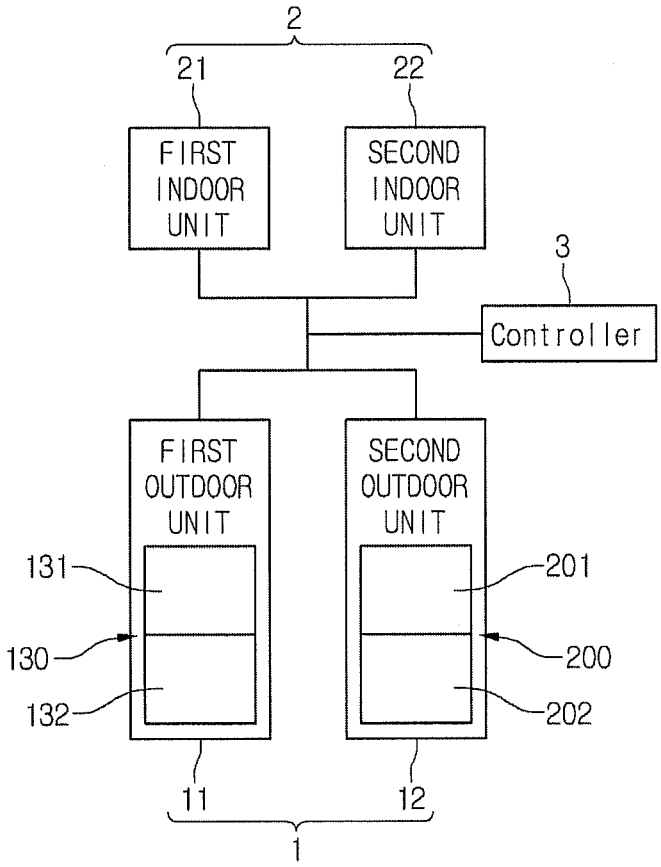
FIG. 1 is a schematic view of an air conditioner according to an embodiment as broadly described herein.

Hereinafter, exemplary embodiments will be described with reference to the accompanying drawings. Wherever possible, the same elements will be designated by the same reference numerals. Also, in the following description, terms such as first, second, A, B, (a), (b) and the like may be used herein when describing various components. These terms do not necessarily define an essence, order or sequence of a corresponding component, but merely distinguish the corresponding component from other component(s). Further, if one component is "connected," "coupled" or "joined" to another component, the former may be directly "connected," "coupled," and "joined" to the latter or "connected", "coupled", and "joined" to the latter via another component.

Figure 2:
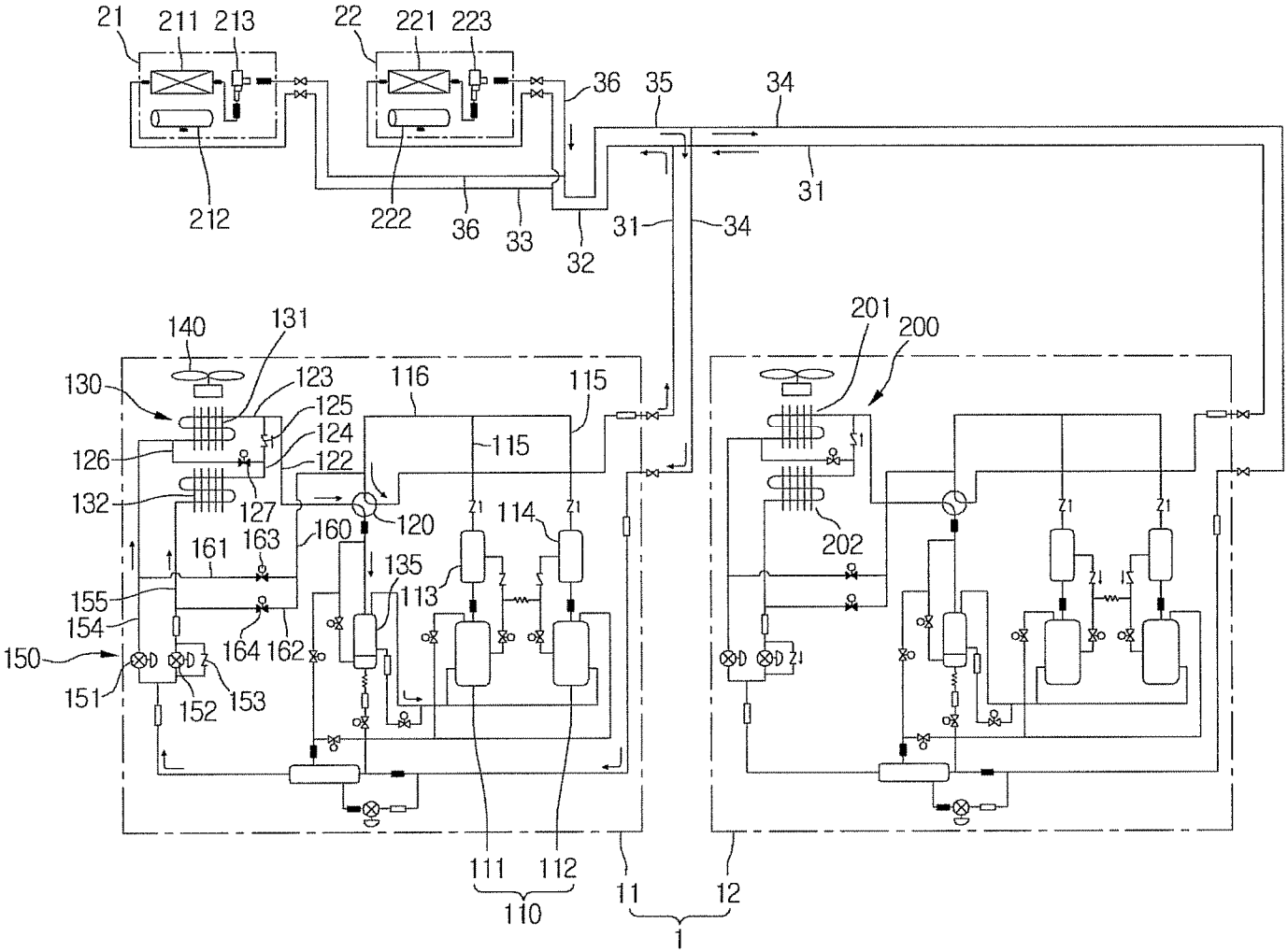
FIG. 2 illustrates a refrigerant cycle of the air conditioner shown in FIG. 1.

Referring to FIGS. 1 and 2, an air conditioner as embodied and broadly described herein may include an outdoor unit 1 and an indoor unit 2 connected to the outdoor unit 1 by a refrigerant pipe and controlled by a controller 3.

The outdoor unit 1 may include a plurality of outdoor units, such as, for example, first and second outdoor units 11 and 12. The indoor unit 2 may include a plurality of indoor units, such as, for example, first and second indoor units 21 and 22. Simply for convenience of description, two indoor units are connected to two outdoor units in the exemplary embodiment shown in FIG. 1. However, two or more outdoor units may be connected to two or more indoor units. Various combinations, numbers, connections and arrangements of indoor units and outdoor units may be appropriate.

The following descriptions of the first outdoor unit 11 may be equally applied to the second outdoor unit 12. Also, reference numerals used for description of the first outdoor unit 11 may be equally applied to the second outdoor unit 12 where appropriate.

As shown in FIG. 2, each of the outdoor units 11 and 12 includes a compression unit 110 for compressing a refrigerant and outdoor heat exchangers 130 and 200 in which outdoor air is heat-exchanged with the refrigerant. The first outdoor unit 11 includes the first outdoor heat exchanger 130, and the second outdoor unit 12 includes the second outdoor heat exchanger 200.

The compression unit 110 may include one or more compressors. For example, the compression unit 110 may include an inverter compressor 111 having variable capacity, and a constant-speed compressor 112. Alternatively, all of the compressors 111 and 112 may be constant-speed compressors or inverter compressors. The plurality of compressors 111 and 112 may be disposed in parallel. A portion of the plurality of compressors 111 and 112 or all of the compressors 111 and 112 may be operated according to the capacity of the indoor unit 2.

A discharge side of each of the compressors 111 and 112 may include an individual pipe 115 joined to a joint pipe 116. Oil separators 113 and 114 for separating oil from the refrigerant may be disposed on the individual pipes 115. The oil separated by the oil separators 113 and 114 may be returned to each of the compressors 111 and 112.

The joint pipe 116 may be connected to a four-way valve 120 for switching a passage of the refrigerant. The four-way valve 120 may connect to the appropriate outdoor heat exchanger 130/200 through a connection pipe unit. The connection pipe unit may include a common connection pipe 122, a first connection pipe 123, and a second connection pipe 124. The four-way valve 120 may also be connected to an accumulator 135, and the accumulator 135 may be connected to the compression unit 110.

Each of the outdoor heat exchangers 130 and 200 may include first heat exchanger parts 131 and 201 and second heat exchanger parts 132 and 202. The first and second heat exchanger parts 131, 201, 132 and 202 may be independent heat exchangers separated from each other, or a heat exchanger divided into two parts or sections based on a refrigerant flow in a single outdoor heat exchanger. The first and second heat exchanger parts 131, 201, 132 and 202 may be horizontally or vertically disposed with respect to each other. Also, the first and second heat exchanger parts 131, 201, 132 and 202 may have substantially the same thermal capacity or thermal capacities that are different from each other.

The first connection pipe 123 may be connected to the first heat exchanger part 131/201, and the second connection pipe 124 may be connected to the second heat exchanger part 132/202. For another example, the first and second connection pipes 123 and 124 may be a portion of the refrigerant pipe constituting each of the heat exchanger parts 131, 201, 132 and 202.

A check valve 125 for allowing the refrigerant to flow in one direction may be provided in the second connection pipe 124. The refrigerant within the second heat exchanger parts 132 and 202 may flow only toward the common connection pipe 122 due to the check valve 125.

The refrigerant within the outdoor heat exchangers 130 and 200 may be heat-exchanged with outdoor air blown by a fan motor assembly 140 (including an outdoor fan and a fan motor). FIG. 2 illustrates one fan motor assembly in each of the outdoor units 11 and 12. However, a plurality of fan motor assemblies may be provided.

Each of the outdoor units 11 and 12 may also include an outdoor expansion mechanism 150. The outdoor expansion mechanism 150 expands a refrigerant before the refrigerant passes through the outdoor heat exchangers 130 and 200.

The outdoor expansion mechanism 150 may include a first outdoor expansion valve 151 connected to the first heat exchanger parts 131 and 201 through a third connection pipe 154 and a second outdoor expansion valve 152 connected to the second heat exchanger parts 132 and 202 through a fourth connection pipe 155. A check valve 153 and the second outdoor expansion valve 152 may be provided in parallel. That is, the check valve 153 may be provided in a parallel pipe disposed parallel to the fourth connection pipe 155. Only the refrigerant passing through the second heat exchanger parts 132 and 202 may flow through the check valve 153.

The refrigerant expanded by the first outdoor expansion valve 151 may flow into the first heat exchanger parts 131 and 201, and the refrigerant expanded by the second outdoor expansion valve 152 may flow into the second heat exchanger parts 132 and 202. Each of the outdoor expansion valves 151 and 152 may be, for example, an electronic expansion valve (EEV), or other type of valve as appropriate.

A pass-variable pipe 126 may be connected to the third connection pipe 154 and the second connection pipe 124, with a pass-variable valve 127 disposed in the pass-variable pipe 126. The pass-variable valve 127 may be, for example, a solenoid valve, or other type of valve as appropriate.

The refrigerant may flow into the first heat exchanger parts 131 and 201 and the second heat exchanger parts 132 and 202 at the same time (i.e., the refrigerant may be distributed into each of the heat exchanger parts to flow in parallel). Alternatively, the refrigerator may first flow into one heat exchanger part and then flow into the other heat exchanger part, or flow into only one heat exchanger part. For another example, refrigerant having in different states (for example, a temperature, pressure, gaseous and liquid state) may respectively flow into the different heat exchanger parts 131, 132, 201 and 202.

For example, when the air conditioner performs a heating operation, the refrigerant may flow into the first heat exchanger parts 131 and 201 and the second heat exchanger parts 132 and 202 at the same time. On the other hand, when the air conditioner performs a cooling operation, the refrigerant may flow first into the first heat exchanger parts 131 and 201 and then flow into the second heat exchanger parts 132 and 202 via the pass-variable pipe 126.

A bypass pipe unit may be connected to the third connection pipe 154 and the fourth connection pipe 155. The bypass pipe unit may be connected to the joint pipe 116. The bypass pipe unit may include a common pipe 160 and first and second bypass pipes 161 and 162 branched from the common pipe 160. The first bypass pipe 161 may be connected to the third connection pipe 154, and the second bypass pipe 162 may be connected to the fourth connection pipe 155. Also, a first bypass valve 163 may be disposed in the first bypass pipe 161, and a second bypass valve 164 may be disposed in the second bypass pipe 162. Each of the bypass valves 163 and 164 may be, for example, a solenoid valve, or other such valve through which a flow rate may be adjusted. Also, the bypass valves 163 and 164 may each serve as decompressor.

Alternatively, the bypass pipe unit may include a first bypass pipe connecting the joint pipe 116 to the third connection pipe 154 and a second bypass pipe connecting to the joint pipe 116 to the fourth connection pipe 115. That is, the common pipe may be omitted in the bypass pipe unit.

When the bypass valves 163 and 164 are opened, a high-temperature refrigerant compressed by the compression unit 110 may flow into the bypass pipes 161 and 162.

The outdoor unit 1 may be connected to the indoor unit 2 through gas pipe units 31, 32 and 33 and liquid pipe units 34, 35 and 36.

The gas pipe units may include an outdoor gas pipe 31, a common gas pipe 32, and an indoor gas pipe 33. The outdoor gas pipe 31 may be connected to the four-way valve 120 of each of the outdoor units 11 and 12. The indoor gas pipe 33 may be connected to the indoor heat exchangers 211 and 221 of each of the indoor units 21 and 22. The common gas pipe 32 may connect the plurality of outdoor gas pipes 31 to the plurality of indoor gas pipes 33.

The liquid pipe unit may include an outdoor liquid pipe 34, a common liquid pipe 35, and an indoor liquid pipe 36. The outdoor liquid pipe 34 may be connected to the outdoor expansion mechanism 150. The indoor liquid pipe 36 may connect to the indoor expansion mechanism 213 and 223 of each of the indoor units 21 and 22. The common liquid pipe 35 may connect the plurality of outdoor liquid pipes 34 to the plurality of indoor liquid pipes 36.

Each of the indoor units 21 and 22 may include indoor heat exchangers 211 and 221, indoor fans 212 and 222, and indoor expansion mechanisms 213 and 223. Each of the indoor expansion mechanisms 213 and 223 may be, for example, an EEV, or other type of valve as appropriate.

Hereinafter, an operation of the air conditioner will be described. For purpose of discussing the defrosting operation of the outdoor exchanger when the air conditioner performs the heating operation, a refrigerant flow when the air conditioner performs the heating operation will be described below.

Referring to FIG. 2, when the air conditioner performs the heating operation, a high-temperature high-pressure refrigerant compressed by the compression unit 110 flows into each of the indoor units 21 and 22 along the gas pipe units 31, 32 and 33 by switching the refrigerant passage through the four-way valve 120. The refrigerant flowing into each of the indoor units 21 and 22 is condensed in the indoor heat exchangers 211 and 221 and then passes through the indoor expansion mechanisms 213 and 223 without being expanded. Then, the refrigerant flows into each of the outdoor units 11 and 12 through the liquid pipe units 34, 35 and 36. The refrigerant flowing into the outdoor units 11 and 12 is expanded by each of the outdoor expansion valves 151 and 152 and then flows into the outdoor heat exchangers 130 and 200. When the air conditioner performs the heating operation, each of the bypass valves 163 and 164 is maintained in a closed state.

Then, the refrigerant is evaporated while passing through the outdoor heat exchangers 130 and 200, and flows into the accumulator 135 via the four-way valves 120. A gaseous refrigerant of the refrigerant introduced into the accumulator 135 is introduced into the compression unit 110.

As described above, when the heating operation is continuously performed, frost may be generated and accumulate on the outdoor heat exchangers 130 and/or 200. Thus, a defrosting operation for removing the frost from the outdoor heat exchangers 130 and/or 200 may be performed.

Figure 3:
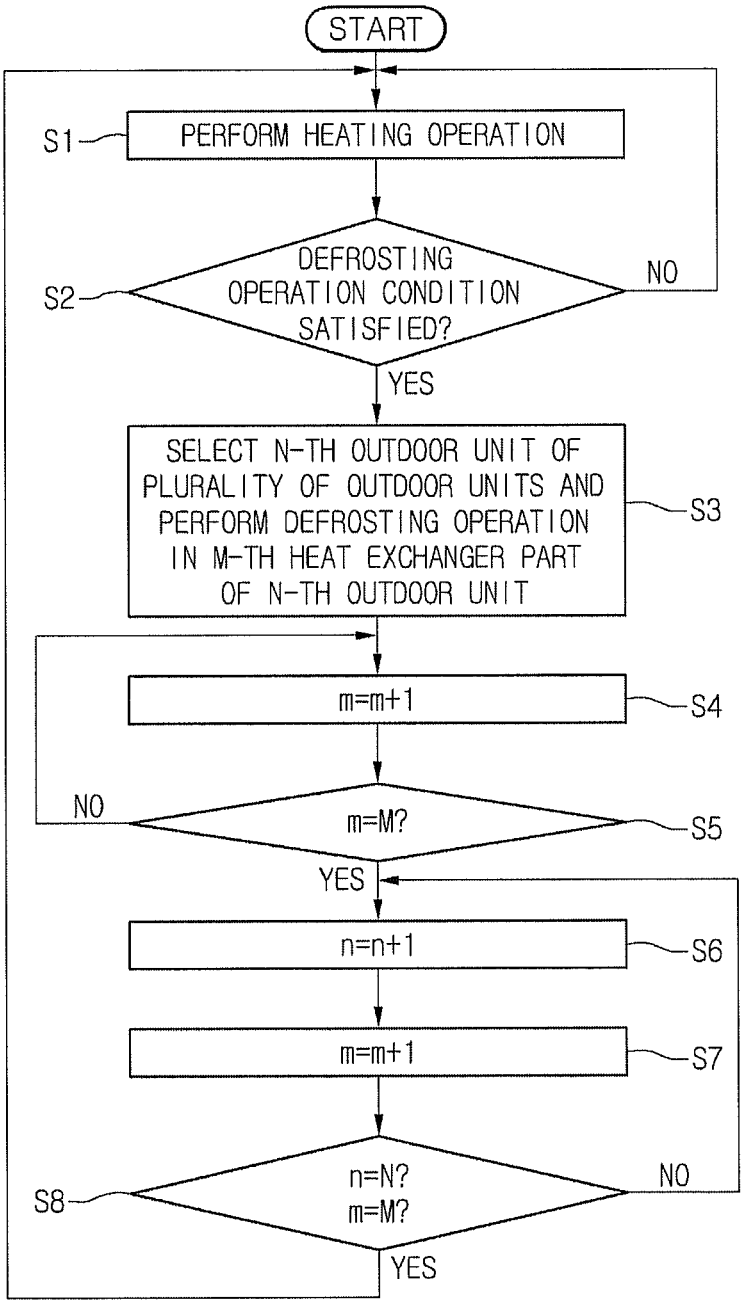
FIG. 3 is a flowchart of a process of controlling an air conditioner according to an embodiment as broadly described herein.
Figure 4:
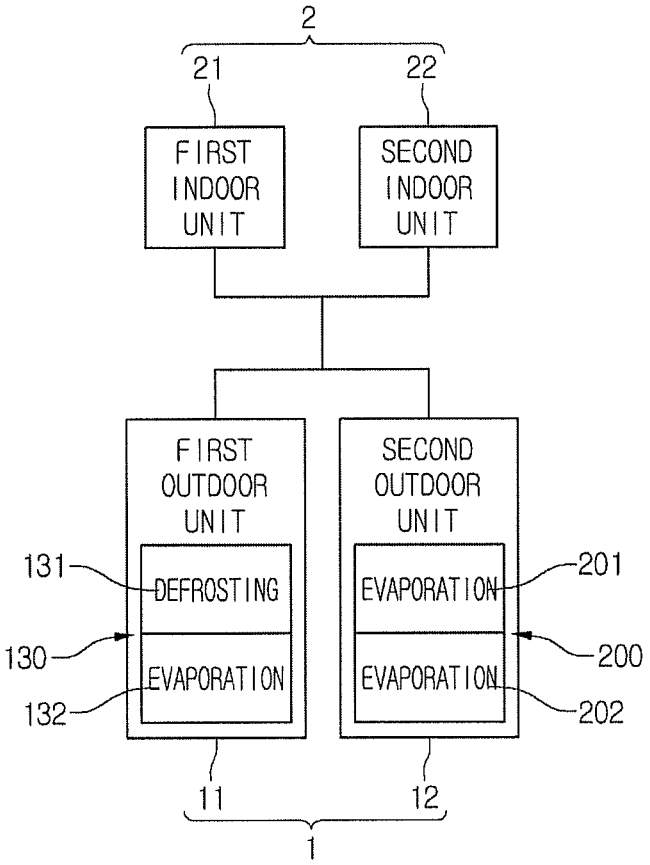
FIGS. 4 to 7 illustrate an order of heat exchanger parts in which defrosting operations may be performed in each of a plurality of outdoor units of an air conditioner as embodied and broadly described herein.
Figure 6:
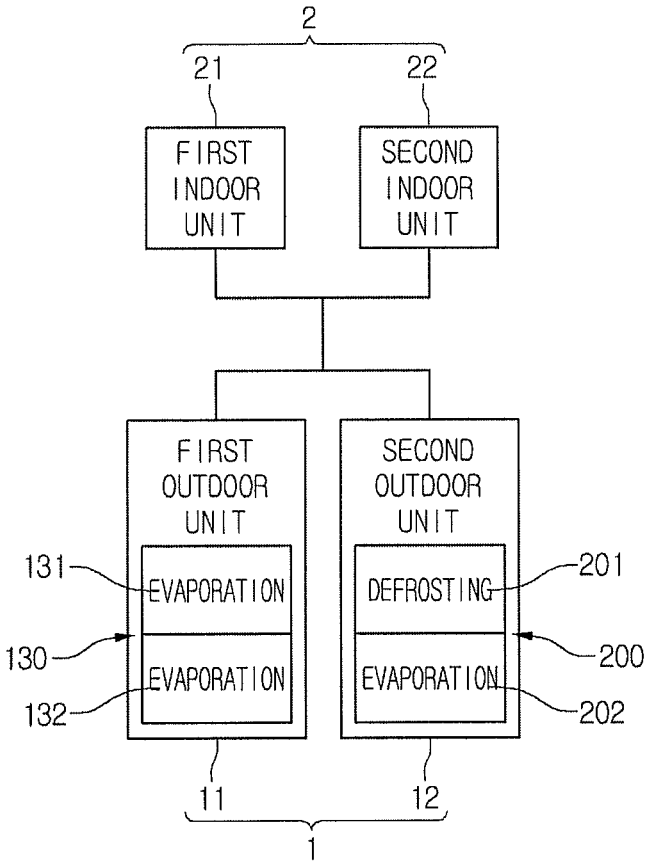
Figure 7:
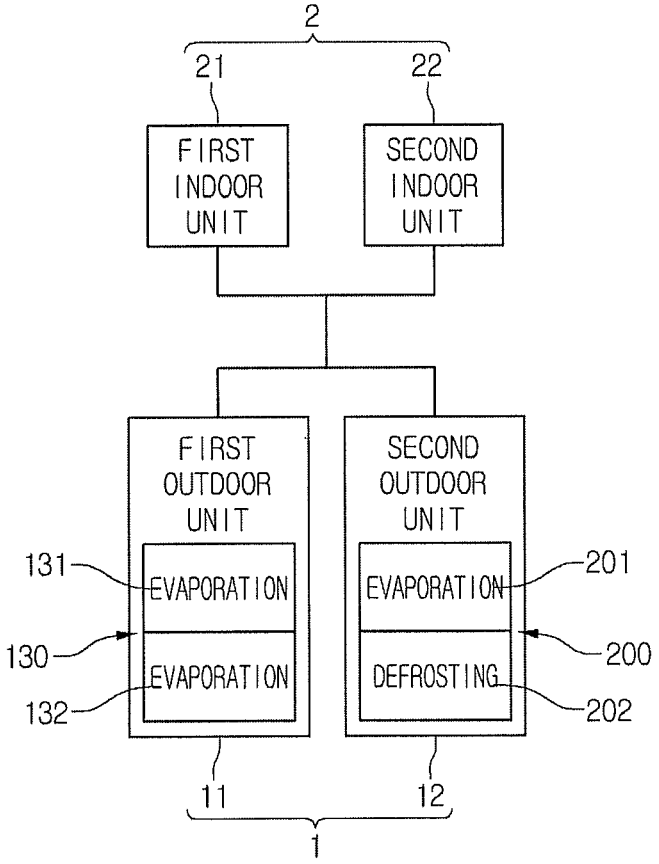
Figure 8:
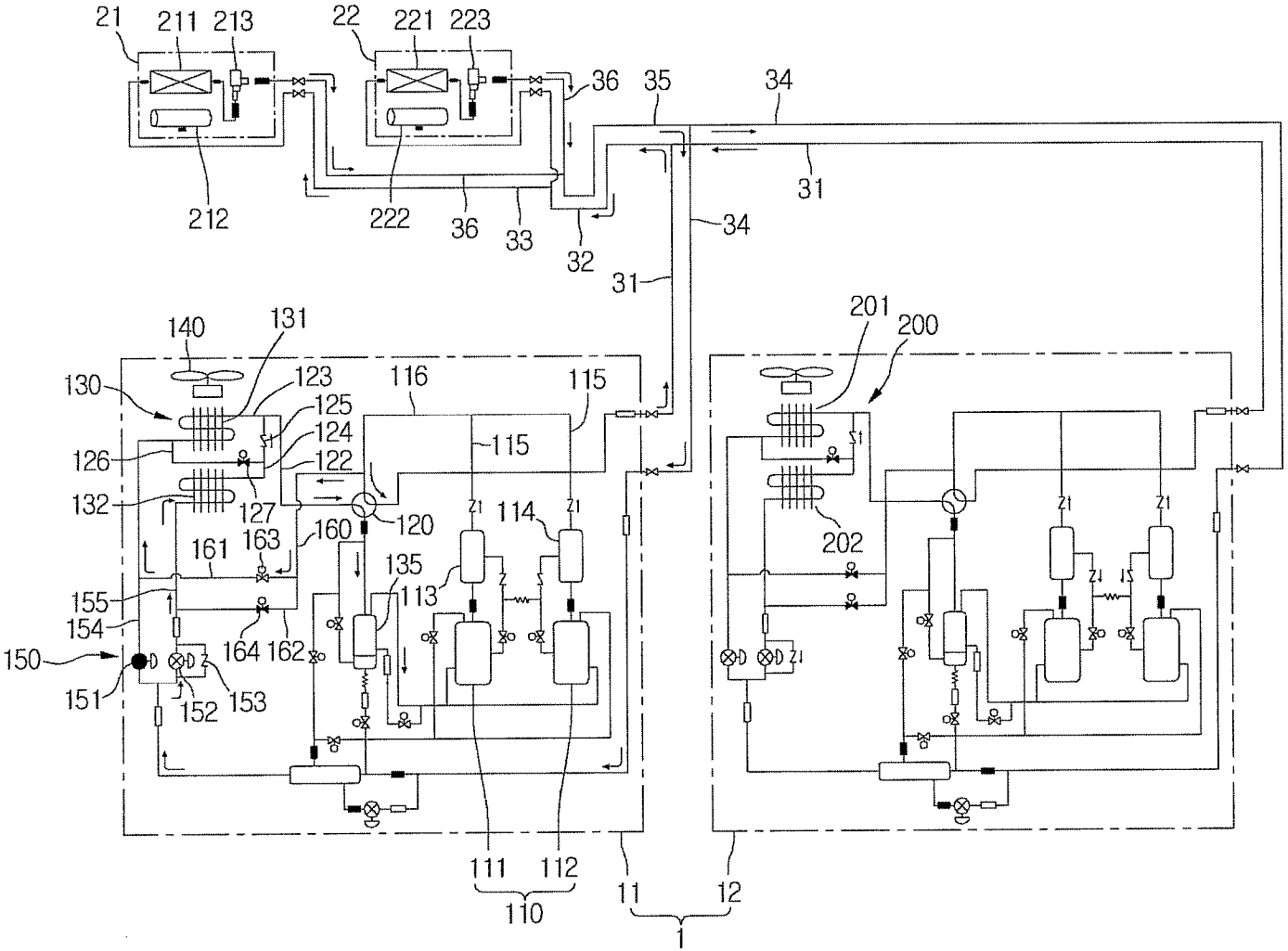
FIGS. 8 and 9 illustrate a refrigerant flow when a specific outdoor heat exchanger performs a defrosting operation.
Figure 9:
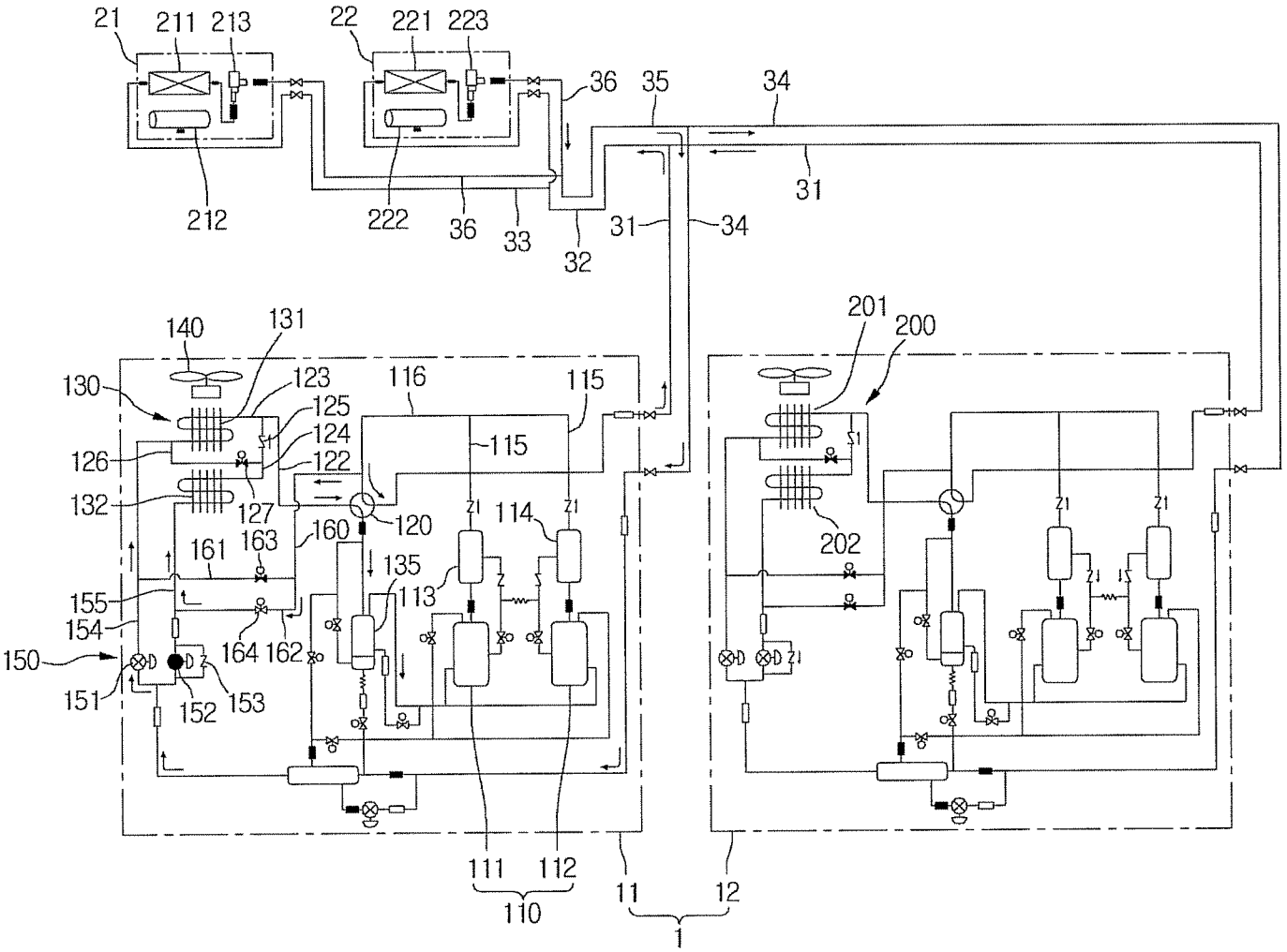

FIG. 3 is a flowchart of controlling an air conditioner according to an embodiment as broadly described herein, and FIGS. 4 to 7 illustrate various orders of heat exchanger parts in which defrosting operations are performed. FIG. 8 illustrates refrigerant flow when the first heat exchanger part of the first outdoor unit performs the defrosting operation, and FIG. 9 illustrates a refrigerant flow when the second heat exchanger part of the first outdoor unit performs the defrosting operation.

Referring to FIGS. 3 to 9, in operation S1, the air conditioner performs a heating operation in response to a heating operation command. When the air conditioner performs the heating operation, the outdoor heat exchangers 130 and 200 of each of the outdoor units 11 and 12 serve as evaporators, and the indoor heat exchangers 211 and 221 of each of the indoor units 21 and 22 serve as condensers.

In operation S2, a controller determines whether defrosting operation conditions are satisfied as the air conditioner performs the heating operation. That is, the controller determines whether operating conditions and factors indicate that a defrosting operation is required.

In this exemplary embodiment, whether the defrosting operation conditions are satisfied may be determined by comparing an outlet pipe temperature of the outdoor heat exchanger to an outdoor temperature. Here, since the plurality of outdoor units are operated at the same time, time points at which the defrosting operation conditions are satisfied at the plurality of outdoor units may be similar. However, under certain circumstances the time points at which the defrosting operation conditions are satisfied in the outdoor units may be different. Depending on a particular installation environment, the defrosting operation conditions may be satisfied in all of the outdoor units or in a reference number of outdoor units. The present disclosure is not limited to a particular method used to determine whether the defrosting operation conditions are satisfied.

If it is determined in the operation S2 that the defrosting operation conditions are satisfied and a defrosting operation is required, the air conditioner is operated in a defrosting operation mode. A specific outdoor unit of the plurality of outdoor units is selected, and a specific heat exchanger part of the selected outdoor unit is selected. That is, in operation S3, an n-th outdoor unit of the plurality of outdoor units is selected, and an m-th heat exchanger part of the selected n-th outdoor unit is selected to perform the defrosting operation.

In the current embodiment, for example, the first outdoor unit 11 may be selected first, and then the second outdoor unit 12 may be selected. Also, in each of the first and second outdoor units 11 and 12, the first heat exchanger part 131/201 may be selected first, and then the second heat exchanger part 132/202 may be selected.

In this example, the specific outdoor unit and the specific heat exchanger part are selected in the operation S3. However, an order of the outdoor units and heat exchanger parts which perform the defrosting operation may be previously decided and stored in a memory. Alternatively, the outdoor unit in which the defrosting operation conditions are satisfied may be selected first in operation S3, and then other outdoor units may be selected according to a successive or specific order. That is, the order of the outdoor units and the heat exchanger parts which perform the deforesting operation may be decided whenever the defrosting operation conditions are satisfied.

In another exemplary embodiment in which a master outdoor unit and a sleeve outdoor unit are disposed between the plurality of outdoor units, the master outdoor unit may be selected first, and then the sleeve outdoor unit may be selected.

In other exemplary embodiment in which the heat exchanger parts of the specific outdoor unit have different capacities, the heat exchanger part having a smaller capacity may perform the defrosting operation first. The present disclosure is not limited to a particular manner of selection of the outdoor for performing the defrosting operation and the selection order of the heat exchangers in the selected outdoor unit.

When the m-th heat exchanger part (e.g., the first heat exchanger part of the first outdoor heat exchanger) performs the defrosting operation, the first bypass valve 163 is opened, and the second bypass valve 164 is closed (or is maintained in a closed state). Also, the first outdoor expansion valve 151 is closed.

When the air conditioner performs the defrosting operation, a refrigerant flow within the indoor unit is essentially the same as the refrigerant flow within the indoor unit during the heating operation. Thus, only a refrigerant flow within the outdoor unit will be described below. Also, a refrigerant flow within the outdoor unit (the outdoor unit that has not been selected in the operation S2) in which the defrosting operation is not performed in the plurality of outdoor units is essentially the same as that within the outdoor unit during the heating operation. Thus, only a refrigerant flow within the outdoor unit in which the defrosting operation is performed will be described below.

A portion of a high-temperature refrigerant compressed by the compressor unit 110 of the first outdoor unit 11 flows into the indoor unit 2 along the gas pipe units 31, 32 and 33, and the remaining portion is bypassed into the bypass pipe unit. Specifically, since the first bypass valve 163 is opened, the refrigerant discharged from the compressor unit 110 flows along the first bypass pipe 161 and into the first heat exchanger part 131 through the third connection pipe 154. The high-temperature refrigerant flowing into the first heat exchanger part 131 melts frost on the first heat exchanger part 131 while flowing through the first heat exchanger part 131. On the other hand, the condensed refrigerant discharged from the indoor unit 2 is expanded while flowing through the second outdoor expansion valve 152 and is then heat-exchanged by the second heat exchanger part 132. The refrigerant passing through the first heat exchanger part 131 and the refrigerant passing through the second heat exchanger part 132 are mixed in the common connection pipe 122 to pass through the four-way valve 120.

Figure 5:
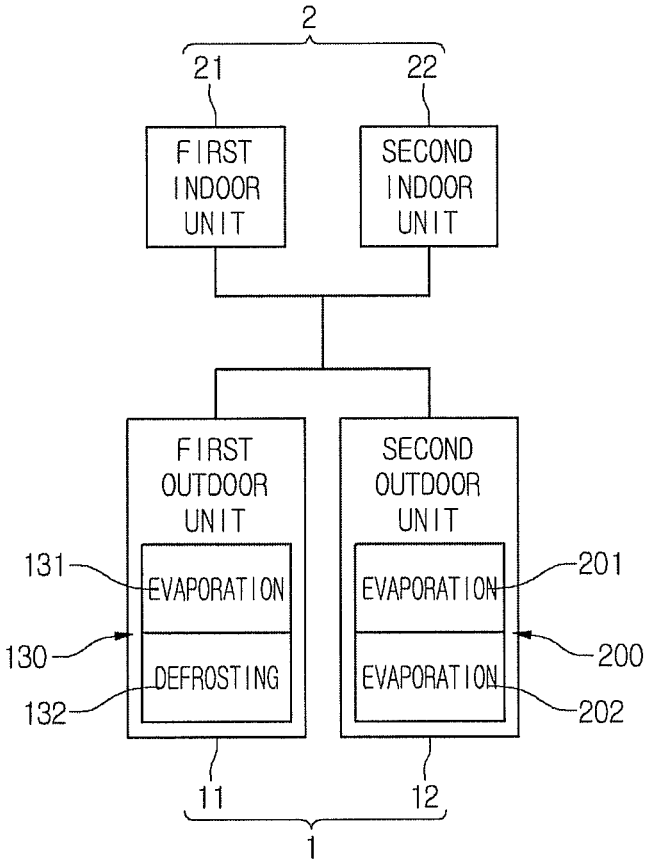

In operation S4, an m+1-th heat exchanger part performs the defrosting operation after the m-th heat exchanger part of the n-th outdoor unit completes its defrosting operation. For example, after the first heat exchanger part 131 of the first outdoor unit 11 completes its defrosting operation, the second heat exchanger part 132 may perform the defrosting operation as shown in FIG. 5. As a result, the first bypass valve 163 is closed, and the second bypass valve 164 is opened. Then, the first outdoor expansion valve 151 is opened, and the second outdoor expansion valve 152 is closed.

A portion of the high-temperature refrigerant discharged from the compression unit 110 flows along the second bypass pipe 162 and into the second heat exchanger part 132 through the fourth connection pipe 155. The high-temperature refrigerant flowing into the second heat exchanger part 132 melts frost on the second heat exchanger part 132 while flowing through the second heat exchanger part 132.

In operation S5, it is determined whether all of the heat exchanger parts of the n-th outdoor unit have completed the defrosting operation after the selected m+1-th heat exchanger part completes the defrosting operation. In the current embodiment, the total number of the heat exchanger parts of the n-th outdoor unit may be defined as an M number.

If it is determined that all of the heat exchanger parts of the n-th outdoor unit have completed the defrosting operation, an n+1-th outdoor unit is selected in operation S6, and then an m-th heat exchanger part of an n+1-th outdoor unit is selected to perform the defrosting operation. In operation S7, an m+1-th heat exchanger part performs the defrosting operation after the m-th heat exchanger part completes its defrosting operation. For example, the first heat exchanger part of the second outdoor unit performs the defrosting operation first as shown in FIG. 6, and then the second heat exchanger part of the second outdoor unit performs the defrosting operation as shown in FIG. 7.

In operation S8, it is determined whether all of the heat exchanger parts of all of the outdoor units have completely performed the defrosting operation during the successive defrosting operation of the heat exchanger parts. In the current embodiment, the total number of the outdoor units may be defined as an N number.

If it is determined that all of the outdoor units have completely performed the defrosting operation, the process returns to the operation S1, and the air conditioner performs the heating operation.

In the current embodiment, the plurality of heat exchanger parts of one outdoor unit successively perform the defrosting operation, and then the plurality of heat exchanger parts of the remaining outdoor unit(s) successively perform the defrosting operation.

Since the indoor unit continuously performs the heating operation during the defrosting operation of the air conditioner, the indoor space may be continuously heated to maintain a desired comfort level in the indoor space.

Also, the entire outdoor unit does not perform the defrosting operation, but rather only one of the heat exchanger parts of the outdoor unit performs the defrosting operation at a time, and then the next heat exchanger part performs the defrosting operation continuing sequentially until all of the heat exchanger parts of the outdoor unit have performed the defrosting operation. Thus, this may prevent heating performance from being deteriorated. That is, since the capacity of the heat exchanger part acting as the evaporator is only minimally reduced, the indoor temperature may be only minimally affected.

In the current embodiment, the plurality of heat exchanger parts of the specific outdoor unit each completely perform the defrosting operation successively, and then the plurality of heat exchanger parts of the next outdoor unit successively perform the defrosting operation. However, the present disclosure is not limited thereto. For example, one of the plurality of heat exchanger parts of a first outdoor unit may perform the defrosting operation and then one of the plurality of heat exchanger parts of a second outdoor unit may perform the defrosting operation. That is, even though the defrosting operation of all of the heat exchanger parts of a specific outdoor unit is not complete, one of the heat exchanger parts of another outdoor unit may perform the defrosting operation. Thus, a defrosting order for the plurality of heat exchanger parts of all of the outdoor units may be determined to allow the plurality of heat exchanger parts to successively perform the defrosting operation while maximizing heating capacity and minimizing an effect on heating provided. Here, the defrosting operation order of the plurality of heat exchanger parts may be previously decided or changed whenever the defrosting operation conditions are satisfied.

Also, the outdoor heat exchanger is divided into the plurality of heat exchanger parts in the current embodiment. However, a portion of the specific outdoor heat exchanger may perform the defrosting operation and then another portion may perform the defrosting operation. Further, a portion of the specific outdoor heat exchanger may perform the defrosting operation and then a portion of the other outdoor heat exchanger may perform the defrosting operation even if the structure in which the outdoor heat exchanger is divided into the plurality of heat exchanger parts is not described.

Even though all the elements of the embodiments are coupled into one or operated in the combined state, the present disclosure is not limited to such an embodiment. That is, all the elements may be selectively combined with each other without departing the scope of the various embodiments as broadly described herein.

An air conditioner as embodied and broadly described herein may include a plurality of indoor units; and a plurality of outdoor units connected to the plurality of indoor units, each of the plurality of outdoor units including a plurality of outdoor heat exchangers, wherein each of the outdoor heat exchangers includes a plurality of heat exchanger parts, and when a defrosting operation condition is satisfied during a heating operation, the plurality of heat exchanger parts constituting the plurality of outdoor heat exchangers successively perform a defrosting operation.

In another embodiment as broadly described herein, an air conditioner may include a plurality of indoor units, each including an indoor heat exchanger; and a plurality of outdoor units connected to the plurality of indoor units, each of the plurality of outdoor units including an outdoor heat exchanger, wherein, when a defrosting operation condition is satisfied during a heating operation, after a portion of a specific outdoor heat exchanger of the plurality of outdoor heat exchangers completely performs a defrosting operation, the other portion of the specific outdoor heat exchanger can perform the defrosting operation.

In still another embodiment as broadly described herein, a method of controlling an air conditioner including a plurality of indoor units and a plurality of outdoor units connected to the plurality of indoor units, each of the plurality of outdoor units including a plurality of outdoor heat exchangers, wherein each of the outdoor heat exchangers is divided into a plurality of heat exchanger parts may include performing a heating operation in the plurality of outdoor units; determining whether a defrosting operation condition is satisfied during the heating operation; and successively performing a defrosting operation in the plurality of heat exchanger parts constituting the plurality of outdoor heat exchangers when the defrosting operation condition is satisfied.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a plurality of indoor devices, each of the plurality of indoor devices respectively including an indoor heat exchanger and an indoor expansion valve;

a plurality of outdoor devices connected to the plurality of indoor devices via a gas pipe and a liquid pipe, each of the plurality of outdoor devices respectively including:

a compression device including one or more compressors;

a four-way valve that switches a flow direction of a refrigerant discharged from the compression device;

a plurality of outdoor heat exchangers, each of the outdoor heat exchangers respectively including a plurality of heat exchangers including a first heat exchanger and a second heat exchanger;

a common connection pipe connected to the four way valve;

a first connection pipe that connects the common connection pipe to a first side of the first heat exchanger;

a second connection pipe that connects the common connection pipe to a first side of the second heat exchanger;

a third connection pipe connected to a second side of the first heat exchanger;

a fourth connection pipe connected to a second side of the second heat exchanger;

a first outdoor expansion valve disposed in the third connection pipe;

a second outdoor expansion valve disposed in the fourth connection pipe;

a joint pipe to connect the compression device to the four-way valve;

a common pipe connected to the joint pipe;

a first bypass pipe that connects the third connection pipe to the common pipe;

a second bypass pipe that connects the fourth connection pipe to the common pipe;

a first bypass valve disposed in the first bypass pipe; and a second bypass valve disposed in the second bypass pipe; and a controller that controls operation of the plurality of indoor devices and the plurality of outdoor devices, wherein the gas pipe connects the four-way valve with the indoor heat exchangers, wherein the liquid pipe connects the indoor expansion valves with the first outdoor expansion valve and the second outdoor expansion valve, wherein the controller controls the first bypass valve, the second bypass valve, the first outdoor expansion valve, and the second outdoor expansion valve to successively perform a defrosting operation, wherein the controller opens the first bypass valve and the second outdoor expansion valve and closes the second bypass valve and the first outdoor expansion valve, wherein refrigerant enters the first bypass pipe without passing through all of the plurality of indoor devices, the gas pipe and the liquid pipe, wherein refrigerant of the first bypass pipe passes through the first heat exchanger and flows into the four-way valve without passing through the second heat exchanger, when the first heat exchanger performs the defrosting operation, wherein the controller opens the second bypass valve and the first outdoor expansion valve and closes the first bypass valve and the second outdoor expansion valve, wherein refrigerant enters the second bypass pipe without passing through all of the plurality of indoor devices, the gas pipe and the liquid pipe, wherein refrigerant of the second bypass pipe passes through the second heat exchanger and flows into the four-way valve without passing through the first heat exchanger, when the second heat exchanger performs the defrosting operation, and wherein the controller opens the first expansion valve and the second expansion valve and closes the first bypass valve and the second bypass valve, when the air conditioner performs a heating operation.

2. The air conditioner of claim 1, wherein the controller controls the plurality of heat exchangers of a first outdoor device of the plurality of outdoor devices to successively perform the defrosting operation, and controls the plurality of heat exchangers of a second outdoor device of the plurality of outdoor devices to successively perform the defrosting operation after the successive defrosting operation has been completed in the plurality of heat exchangers of the first outdoor device.

3. The air conditioner of claim 1, wherein the controller controls a first outdoor device of the plurality of outdoor devices to perform the defrosting operation in the respective plurality of heat exchangers of the first outdoor device of the plurality of outdoor devices, and then controls a second outdoor device of the plurality of outdoor devices to perform the defrosting operation in the respective plurality of heat exchangers of the second outdoor device of the plurality of outdoor devices.

4. The air conditioner according to claim 1, wherein the controller controls the plurality of heat exchangers such that a current heat exchanger initiates the defrosting operation only after a previous heat exchanger completely performs the defrosting operation.

5. The air conditioner of claim 1, wherein the controller controls the plurality of heat exchangers of the plurality of outdoor devices to perform the defrosting operation based on a previously stored order of the plurality of outdoor devices and a previously stored order of the plurality of heat exchangers of each of the plurality of outdoor devices.

6. The air conditioner according to claim 1, wherein the controller determines an order in which the plurality of outdoor devices and the plurality of heat exchangers of each of the plurality of outdoor devices are to perform the defrosting operation based on an order in which defrosting conditions are satisfied in the plurality of heat exchangers, and controls the plurality of heat exchangers to perform the defrosting operation in the determined order.

* * * * *